US006733599B2

(12) United States Patent
Fujii et al.

(10) Patent No.: US 6,733,599 B2
(45) Date of Patent: May 11, 2004

(54) METHOD FOR PRODUCING GRAIN-ORIENTED SILICON STEEL SHEET NOT HAVING INORGANIC MINERAL FILM

(75) Inventors: Hiroyasu Fujii, Kitakyushu (JP); Yoshiyuki Ushigami, Futtsu (JP); Shuichi Nakamura, Futtsu (JP); Kenichi Murakami, Kitakyushu (JP); Norihiro Yamamoto, Kitakyushu (JP); Kiyoshi Sawano, Futtsu (JP); Shuichi Yamazaki, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/312,115

(22) PCT Filed: Apr. 23, 2002

(86) PCT No.: PCT/JP02/04051

§ 371 (c)(1),
(2), (4) Date: Dec. 20, 2002

(87) PCT Pub. No.: WO02/088403

PCT Pub. Date: Nov. 7, 2002

(65) Prior Publication Data

US 2003/0188806 A1 Oct. 9, 2003

(30) Foreign Application Priority Data

| | | |
|---|---|---|
| Apr. 23, 2001 | (JP) | 2001-124882 |
| Jun. 7, 2001 | (JP) | 2001-172885 |
| Jun. 7, 2001 | (JP) | 2001-172913 |
| Jul. 19, 2001 | (JP) | 2001-220228 |

(51) Int. Cl.[7] ..... H01F 1/14
(52) U.S. Cl. ..... 148/113; 148/111

(58) Field of Search ..... 148/110–113

(56) References Cited

U.S. PATENT DOCUMENTS

| | | | | |
|---|---|---|---|---|
| 3,765,957 A | * | 10/1973 | Hamachi et al. | 148/113 |
| 4,582,547 A | * | 4/1986 | Price | 148/113 |
| 4,871,402 A | * | 10/1989 | Toker et al. | 148/113 |

FOREIGN PATENT DOCUMENTS

| | | |
|---|---|---|
| JP | 7-62427 | 3/1995 |
| JP | 7-118750 | 5/1995 |
| JP | 9-256068 | 9/1997 |
| JP | 11-302730 | 11/1999 |
| JP | 11-302731 | 11/1999 |
| JP | 2000-38615 | 2/2000 |

* cited by examiner

*Primary Examiner*—John Sheehan
(74) *Attorney, Agent, or Firm*—Kenyon & Kenyon

(57) ABSTRACT

The present invention provides a method for producing a grain-oriented silicon steel sheet not having inorganic mineral films by using an annealing separator capable of preventing the inorganic mineral films composed of forsterite ($Mg_2SiO_4$), and so on, from forming during final annealing, comprising the steps of decarburization annealing followed by coating of annealing separator and final annealing, wherein alumina powder calcined at a calcination temperature of 900 to 1,400° C., or further having a BET specific surface area of 1 to 100 $m^2/g$, an oil absorption of 1 to 70 ml/100 g, and/or having a gamma ratio of 0.001 to 2.0, is used as the annealing separator. Magnesia having a BET specific surface area of 0.5 to 5 $m^2/g$ may be added to said alumina powder.

7 Claims, 1 Drawing Sheet

4μm

METHOD FOR PRODUCING GRAIN-ORIENTED SILICON STEEL SHEET NOT HAVING INORGANIC MINERAL FILM

TECHNICAL FIELD

The present invention relates to a method for producing a grain-oriented silicon steel sheet, not having inorganic mineral films, by using an annealing separator capable of preventing inorganic mineral film composed of forsterite ($Mg_2SiO_4$), and so on, from forming during final annealing.

BACKGROUND ART

A grain-oriented silicon steel sheet is widely used as a material for magnetic cores and, for minimizing energy loss in particular, a silicon steel sheet having a small core loss has been sought. It is effective to impose a tension on a steel sheet for reducing a core loss. For this reason, it has been a common practice to create a tension and to reduce a core loss by forming coating films consisting of a material having a smaller thermal expansion coefficient than that of a steel sheet at a high temperature. A film of a forsterite type formed through the reaction of oxides on a steel sheet surface with an annealing separator in a final annealing process creates a tension in the steel sheet, and the adhesiveness of the film is excellent.

For example, the method for forming insulating coating films by coating the surfaces of a steel sheet with a coating liquid mainly consisting of colloidal silica and phosphate and by baking it, as disclosed in Japanese Unexamined Patent Publication No. S48-39338, has a significant effect on creating a tension in the steel sheet and is effective in reducing the core loss.

Therefore, the method of keeping the films of a forsterite type formed in a final annealing process and then forming insulating coating films mainly consisting of phosphate is generally employed as a method for producing a grain-oriented silicon steel sheet.

In recent years, it has been clarified that the disordered interfacial structure of a forsterite type film and a base metal deteriorates the effect of a film tension on improving a core loss to some extent. In view of this, a technology has been developed which attempts to further reduce a core loss by forming anew tension-creating coating films after removing the forsterite type films formed in a finish annealing process and/or further applying a mirror-finish, as disclosed in Japanese Unexamined Patent Publication No. S49-96920 for example.

However, the removal of a forsterite type coating film intruding into a steel sheet requires a labor. For instance, when the removal of the film by pickling is attempted, as forsterite contains a silica component, it is necessary to dip the film for a long time in a liquid of strong acid, such as hydrofluorid acid, capable of dissolving even a silica component. On the other hand, when the removal of the film by such a means as mechanical surface grinding is attempted, it is necessary to grind a steel sheet to a depth of nearly 10 $\mu$m to completely remove the intruding portions of the film and thus the means is hardly acceptable from the viewpoint of the yield. What is more, the method of removing a film by grinding unavoidably introduces a strain in the steel sheet during the grinding work and causes deterioration of magnetic properties.

In consideration of the above, a technology of not forming inorganic mineral coating films composed of forsterite and so on during final annealing has been studied, rather than the technology of removing the forsterite films formed during a final annealing process after the annealing. During the course of the study, alumina attracted attention as an annealing separator with which oxides hardly remained after final annealing and, as a consequence, various technologies were disclosed in relation to an annealing separator consisting mainly of alumina.

For example, U.S. Pat. No. 3,785,882 discloses a method wherein alumina at 99% or more in purity and 100 to 400 mesh in grain size is used as an annealing separator, and Japanese Unexamined Patent Publication No. S56-65983 discloses another method wherein an annealing separator mainly composed of aluminum hydroxide is used in annealing. Besides these, Japanese Examined Patent Publication No. S48-19050 discloses a method wherein an annealing separator produced by adding an alkali metallic compound containing a boric acid component to alumina is used in annealing.

Further, Japanese Examined Patent Publication No. S56-3414 discloses a method wherein an annealing separator containing hydrous silicate powder by 5 to 40% with the balance consisting of alumina is used in annealing, and Japanese Examined Patent Publication No. S58-44152 discloses a technology wherein an annealing separator containing, in addition to hydrous silicate powder, a compound of strontium and/or barium by 0.2 to 20% and calcia and/or calcium hydroxide by 2 to 30% with the balance consisting of alumina is used in annealing.

More recently, Japanese Unexamined Patent Publication No. H7-18457 discloses a method wherein a mixture of coarse alumina with an average grain size of 1 to 50 $\mu$m and fine alumina with an average grain size of 1 $\mu$m or less is used as an annealing separator.

In many of the disclosed technologies wherein alumina is used as an annealing separator, the grain size of the alumina is prescribed.

In addition, Japanese Unexamined Patent Publication No. S59-96278 discloses a method wherein inert magnesia having a specific surface area of 0.5 to 10 $m^2/g$, which is produced by calcining it at 1,300° C. or higher and then crushing it, is added by 15 to 70 to alumina of 100 in terms of weight.

The effect of preventing the formation of a forsterite film can be obtained to some extent by employing any of the above methods and applying finish annealing to a steel sheet after it is subjected to decarburization annealing. However, it has been difficult to stably produce a final-annealed steel sheet on which neither forsterite films are formed nor oxides remain.

DISCLOSURE OF THE INVENTION

The present invention is a method of stably producing a final-annealed steel sheet on which neither forsterite films are formed nor oxides remain by solving the above problems, and the gist of the present invention is as follows:

(1) A method for producing a grain-oriented silicon steel sheet not having inorganic mineral coating films, comprising the steps of decarburization annealing, the coating an annealing separator and final annealing, wherein alumina powder calcined at a calcining temperature of 900 to 1,400° C. is used as an annealing separator.

(2) A method for producing a grain-oriented silicon steel sheet not having inorganic mineral films comprising the steps of decarburization annealing followed by coating of annealing separator and final annealing, according to the item (1), wherein the alumina powder having a BET specific surface area of 1 to 100 $m^2/g$ is used as an annealing separator.

(3) A method for producing a grain-oriented silicon steel sheet not having inorganic mineral films comprising the steps of decarburization annealing followed by coating of annealing separator and final annealing, according to the item (1) or (2), wherein the alumina powder having an oil absorption of 1 to 70 ml/100 g is used as an annealing separator.

(4) A method for producing a grain-oriented silicon steel sheet not having inorganic mineral films comprising the steps of decarburization annealing followed by coating of annealing separator and final annealing, according to any one of the items (1) to (3), wherein the alumina powder having a $\gamma$ ratio of 0.001 to 2.0 is used as the annealing separator, where the $\gamma$ ratio is the ratio of the diffraction intensity from the (440) plane of a $\gamma$-alumina phase to the diffraction intensity from the (113) plane of an $\alpha$-alumina phase in the measurement of the alumina powder by X-ray diffraction method.

(5) A method for producing a grain-oriented silicon steel sheet not having inorganic mineral films according to any one of the items (1) to (4), further comprising the step of mixing magnesia having a BET specific surface area of 0.5 to 5 $m^2/g$ is added to the alumina powder by 5 to 30 weight % relative to the total weight of the alumina powder and the magnesia powder.

(6) A method for producing a grain-oriented silicon steel sheet not having inorganic mineral films according to any one of the items (1) to (5), wherein the average grain size(s) of the alumina powder, and/or the magnesia powder if added, is/are 200 $\mu$m or less.

BEST MODE FOR CARRYING OUT THE INVENTION

Figure 1:
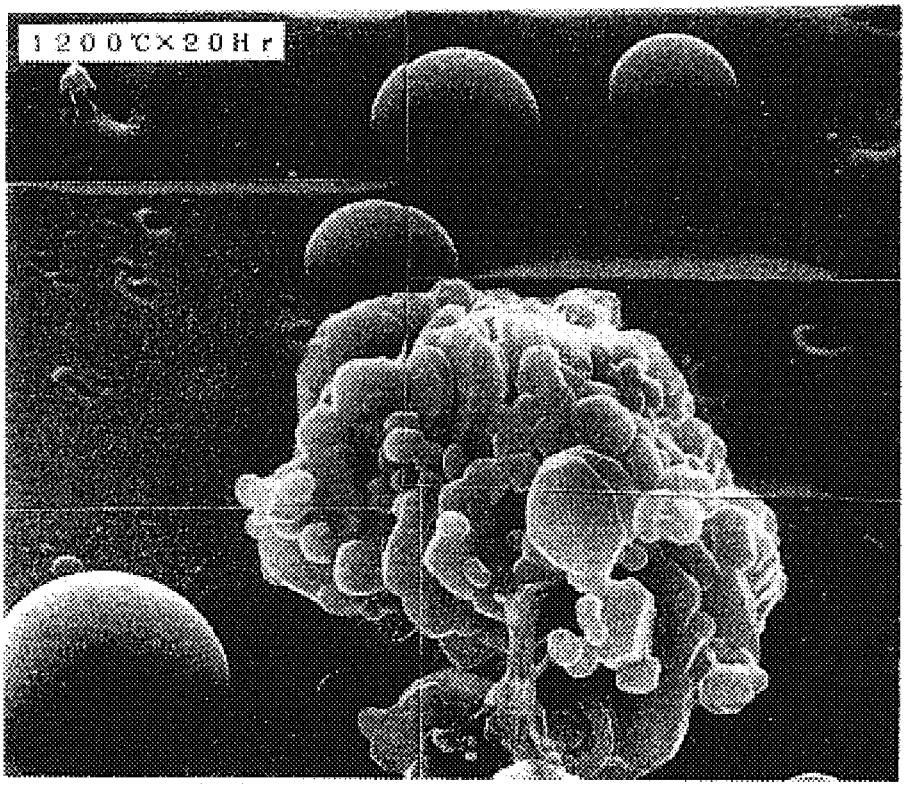
FIG. 1 is a photograph showing the appearance of a steel sheet surface when alumina powder having a smaller BET specific surface area is used as an annealing separator in annealing compared to the present invention.

The present invention is explained hereafter in detail.

The present inventors assiduously studied the reasons why the effects of stably preventing the formation of a forsterite film and inhibiting oxides from remaining were not obtained even when an annealing separator consisting mainly of alumina was used in annealing. In the studies, they carried out detailed analyses especially of the structural change of surface oxide layers occurring during the heating stage of final annealing and the subsequent process of thermal smoothing of a sheet surface. Through the studies and analyses, they discovered that the effect of preventing oxides from remaining was widely varied depending on the temperature at which alumina was calcined even when the grain size of the alumina was the same.

(Calcination Temperature)

The present inventors carried out the following test and examined the relationship between a calcination temperature of alumina and a capacity thereof to prevent oxides from remaining.

As test pieces, steel sheets of 0.225 mm in thickness after being subjected to decarburization annealing were coated with annealing separator consisting mainly of alumina and they were subjected to final annealing for secondary recrystallization. At this time, 12 different kinds of alumina powder calcined at 500 to 1,600° C. were prepared in the form of water slurry and the steel sheets were coated with the slurry and dried. Then, the steel sheets were subjected to final annealing at 1,200° C. for 20 h. in a dry hydrogen atmosphere. The annealed steel sheets were cleaned of superfluous alumina remaining on the surfaces by wiping the surfaces with waste cloth in running water. The steel sheets thus prepared were analyzed and evaluated. Table 1 shows the results.

Note that the degree of the effect of preventing oxides from remaining was evaluated with the oxygen amount of a final-annealed sheet determined by a chemical analysis. A large oxygen amount of a steel sheet means that oxides remain abundantly on the surfaces of the steel sheet and a small oxygen amount of a steel sheet means that oxides do not remain on the surfaces. The evaluation criterion was defined as follows: a steel sheet showing an oxygen amount over 100 ppm was marked with X, and that showing an oxygen amount of 100 ppm or less was marked with ○. A magnetic property was evaluated in terms of flux density (B8), and a steel sheet showing a value of B8 of 1.94 T or more was marked with ○, that showing a value of B8 in the range from 1.93 to 1.90 T was marked with Δ, and that showing a value of B8 below 1.90 T was marked with X.

TABLE 1

Relationship of calcination temperature of alumina with capacity to prevent oxides from remaining and magnetic property

| Condition number | Calcination temperature of alumina used (° C.) | Capacity to prevent oxides from remaining: Oxygen amount of final-annealed steel sheet (ppm) | Capacity to prevent oxides from remaining: Evaluation | Magnetic property: Flux density: B8 (T) | Magnetic property: Evaluation | Overall evaluation |
|---|---|---|---|---|---|---|
| 1 | 500 | 552 | X | 1.82 | X | X |
| 2 | 600 | 481 | X | 1.84 | X | X |
| 3 | 700 | 347 | X | 1.85 | X | X |
| 4 | 800 | 105 | X | 1.87 | X | X |
| 5 | 900 | 71 | ○ | 1.95 | ○ | ○ |
| 6 | 1000 | 41 | ○ | 1.94 | ○ | ○ |
| 7 | 1100 | 39 | ○ | 1.96 | ○ | ○ |
| 8 | 1200 | 35 | ○ | 1.94 | ○ | ○ |
| 9 | 1300 | 43 | ○ | 1.94 | ○ | ○ |
| 10 | 1400 | 89 | ○ | 1.95 | ○ | ○ |
| 11 | 1500 | 589 | X | 1.92 | Δ | X |
| 12 | 1600 | 756 | X | 1.88 | X | X |

In Table 1, the steel sheets showing the high capacities to prevent oxides from remaining, namely having small amounts of remaining oxides on the steel sheet surfaces after final annealing, were the ones having the condition numbers 5 to 10 wherein the calcination temperatures of alumina were from 900 to 1,400° C. In case of the condition numbers 1 to 4 wherein the calcination temperatures were as low as 500 to 800° C., the amounts of remaining oxides were as high as 105 to 552 ppm in terms of the analysis value of the oxygen amount. In contrast, in case of the condition numbers 11 and 12 wherein the calcination temperatures were as high as 1,500 and 1,600° C., the amounts of remaining oxides were as high as 589 and 756 ppm, respectively, in terms of the analysis value of the oxygen amount, showing low capacities to prevent oxides from remaining.

With respect to a magnetic property, whereas the flux densities were as good as 1.94 T or more in case of the condition numbers ⑤ to ⑩ wherein the calcination temperatures were from 900 to 1,400° C., the flux densities were as low as 1.87 T or less in case of the condition numbers ① to ④ wherein the calcination temperatures were as low as 500 to 800° C. and, in contrast, the flux density was 1.92 T which was somewhat low in case of the condition number ⑪ wherein the calcination temperature was as high as 1,500° C., and the flux density was 1.88 T which was lower still and poor in case of the condition number ⑫ wherein the calcination temperature was 1,600° C. which was yet higher.

From the above results, it has been clarified that, when the steel sheets are evaluated in terms of the two items, namely the capacity to prevent oxides from remaining and the magnetic property, the steel sheets under the conditions that the calcination temperatures of alumina are from 900 to 1,400° C. are good.

The mechanism by which a capacity to prevent oxides from remaining depends on a calcination temperature of alumina will be discussed later together with the dependences thereof on a BET specific surface area, an oil absorption and a γ ratio of alumina, after all these subjects are explained.

(BET Specific Surface Area)

The present inventors discovered that there was a close relationship between a capacity to prevent oxides from remaining and a calcination temperature of alumina. However, if a capacity to prevent oxides from remaining can be controlled by the physical properties of alumina when alumina is purchased and used for the coating of a steel sheet, it is possible to stably prevent oxides from remaining and to produce a final-annealed steel sheet not having inorganic mineral films after final annealing.

The present inventors anticipated that there might be a relationship between a BET specific surface area of alumina and a capacity to prevent oxides from remaining, and they investigated the relationship between the two.

As test pieces, steel sheets of 0.225 mm in thickness after being subjected to decarburization annealing were coated with annealing separator consisting mainly of alumina and they were subjected to final annealing for secondary recrystallization. At this time, 12 different kinds of alumina powder having the BET specific surface areas ranging from 0.6 to 305.6 $m^2/g$ were prepared in the form of water slurry and the steel sheets were coated with the slurry and dried. Then, the steel sheets were subjected to final annealing at 1,200° C. for 20 h. in a dry hydrogen atmosphere. The annealed steel sheets were cleaned of superfluous alumina remaining on the surfaces by wiping the surfaces with waste cloth in running water. The steel sheets thus prepared were analyzed and evaluated. Table 2 shows the results.

Note that the analysis method and the evaluation criteria were the same as those employed when the dependence of a capacity to prevent oxides from remaining on a calcination temperature of alumina was examined.

A BET specific surface area is a value obtained by having the surfaces of particles adsorb an inert gas such as argon and measuring the pressures before and after the adsorption. This is a method commonly employed for evaluating the surface area of powder of an inorganic mineral substance.

TABLE 2

Relationship of BET specific surface area of alumina with capacity to prevent oxides from remaining and magnetic property

| Condition number | BET specific surface area of alumina used ($m^2/g$) | Capacity to prevent oxides from remaining: Oxygen amount of final-annealed steel sheet (ppm) | Capacity to prevent oxides from remaining: Evaluation | Magnetic property: Flux density: B8 (T) | Magnetic property: Evaluation | Overall evaluation |
|---|---|---|---|---|---|---|
| ① | 0.6 | 320 | X | 1.93 | Δ | X |
| ② | 1.0 | 98 | ○ | 1.95 | ○ | ○ |
| ③ | 1.5 | 82 | ○ | 1.94 | ○ | ○ |
| ④ | 3.2 | 49 | ○ | 1.94 | ○ | ○ |
| ⑤ | 6.1 | 41 | ○ | 1.96 | ○ | ○ |
| ⑥ | 8.5 | 38 | ○ | 1.95 | ○ | ○ |
| ⑦ | 12.4 | 35 | ○ | 1.94 | ○ | ○ |
| ⑧ | 43.9 | 44 | ○ | 1.94 | ○ | ○ |
| ⑨ | 72.7 | 49 | ○ | 1.95 | ○ | ○ |
| ⑩ | 100.0 | 97 | ○ | 1.95 | ○ | ○ |
| ⑪ | 152.6 | 450 | X | 1.91 | Δ | X |
| ⑫ | 305.6 | 621 | X | 1.88 | X | X |

In Table 2, the steel sheets showing the high capacities to prevent oxides from remaining, namely having small amounts of remaining oxides on the steel sheet surfaces after final annealing, were the ones having the condition numbers ② to ⑩ wherein the BET specific surface areas were from 1.0 to 100.0 $m^2/g$. In case of the condition number ① wherein the BET specific surface area was as small as 0.6 $m^2/g$, the amount of remaining oxides was as high as 320 ppm in terms of the analysis value of the oxygen amount In contrast, in case of the condition numbers ⑪ and ⑫ wherein the BET specific surface areas were as large as 152.6 and 305.6 $m^2/g$, the amounts of remaining oxides were as high as 450 and 621 ppm, respectively, in terms of the analysis value of the oxygen amount, showing the low capacities to prevent oxides from remaining.

With respect to a magnetic property, whereas the flux densities were as good as 1.94 T or more in case of the condition numbers ② to ⑩ wherein the BET specific surface areas were from 1.0 to 100.0 $m^2/g$, the flux density was 1.93 T which was somewhat low in case of the condition number ① wherein the surface area was as small as 0.6 $m^2/g$ in terms of the BET specific surface area, in contrast, the flux density was as low as 1.91 T in case of the condition number ⑪ wherein the surface area was as large as 152.6 $m^2/g$ in terms of the BET specific surface area, and the flux density was 1.88 T which was lower still and poor in case of the condition number ⑫ wherein the surface area was 305.6 $m^2/g$ which was yet larger in terms of the BET specific surface area.

From the above results, it has been clarified that, when the steel sheets are evaluated in terms of the two items, namely the capacity to prevent oxides from remaining and the magnetic property, the steel sheets under the conditions that the BET specific surface areas are from 1.0 to 100.0 $m^2/g$, are good.

(Oil Absorption)

It was clarified that, in producing a final-annealed sheet not having inorganic mineral films by using alumina as an annealing separator, it was possible to stably prevent oxides from remaining as long as the BET specific surface area of the alumina was controlled. However, the measurement of a BET specific surface area requires special equipment, and it takes a certain period of time to measure it.

The present inventors further studied in search of a simpler analysis means for identifying the kind of alumina having an excellent capacity to prevent oxide from remaining. During the course of the studies, they discovered the fact that the effect of alumina on preventing oxides from remaining significantly varied depending on the amount of oil that the alumina could absorb.

Thus, the present inventors carried out the following test and examined the relationship between an oil absorption of alumina and a capacity thereof to prevent oxides from remaining.

As test pieces, steel sheets 0.225 mm in thickness after being subjected to decarburization annealing were coated with annealing separator consisting mainly of alumina and they were subjected to final annealing for secondary recrystallization. At this time, 10 different kinds of alumina powder having oil absorptions ranging from 0.5 to 80.4 ml/100 g were prepared in the form of water slurry and the steel sheets were coated with the slurry and dried.

An oil absorption mentioned here is an index defined by the amount, which is expressed by ml, of linseed oil that alumina powder 100 g in weight can absorb.

Then, the steel sheets were subjected to final annealing at 1,200° C. for 20 h. in a dry hydrogen atmosphere. The annealed steel sheets were cleaned of superfluous alumina remaining on the surfaces by wiping the surfaces with waste cloth in running water. The steel sheets thus prepared were analyzed and evaluated. Table 3 shows the results.

Note that the analysis method and the evaluation criteria were the same as those employed when the dependence of a capacity to prevent oxides from remaining on a calcination temperature of alumina was examined.

TABLE 3

Relationship of oil absorption of alumina with capacity to prevent oxides from remaining and magnetic property

| Condition number | Oil absorption of alumina used (ml/100 g) | Capacity to prevent oxides from remaining: Oxygen amount of final-annealed steel sheet (ppm) | Capacity to prevent oxides from remaining: Evaluation | Magnetic property: Flux density: B8 (T) | Magnetic property: Evaluation | Overall evaluation |
|---|---|---|---|---|---|---|
| 1 | 0.5 | 420 | X | 1.92 | Δ | X |
| 2 | 1.0 | 95 | ○ | 1.94 | ○ | ○ |
| 3 | 2.2 | 79 | ○ | 1.95 | ○ | ○ |
| 4 | 4.7 | 54 | ○ | 1.95 | ○ | ○ |
| 5 | 6.1 | 47 | ○ | 1.96 | ○ | ○ |
| 6 | 18.5 | 33 | ○ | 1.95 | ○ | ○ |
| 7 | 32.6 | 36 | ○ | 1.96 | ○ | ○ |
| 8 | 63.3 | 41 | ○ | 1.95 | ○ | ○ |
| 9 | 70.0 | 52 | ○ | 1.94 | ○ | ○ |
| 10 | 80.4 | 458 | X | 1.89 | X | X |

In Table 3, the steel sheets showing the high capacities to prevent oxides from remaining, namely having small amounts of remaining oxides on the steel sheet surfaces after final annealing, were the ones having the condition numbers 2 to 9 wherein the oil absorptions were from 1.0 to 70.0 ml/100 g. In case of the condition number 1 wherein the oil absorption was as small as 0.5 ml/100 g, the amount of remaining oxides was as high as 420 ppm in terms of the analysis value of the oxygen amount. In contrast, in case of the condition number 10 wherein the oil absorption was as high as 80.4 ml/100 g, the amount of remaining oxides was as high as 458 ppm in terms of the analysis value of the oxygen amount, showing the low capacity to prevent oxides from remaining.

With respect to a magnetic property, whereas the flux densities were as good as 1.94 T or more in case of the condition numbers 2 to 9 wherein the oil absorptions were from 1.0 to 70.0 ml/100 g, the flux density was 1.92 T which was somewhat low in case of the condition number 1 wherein the oil absorption was as small as 0.5 ml/100 g and, in contrast, the flux density was as low as 1.89 T and poor in case of the condition number 10 wherein the oil absorption was as large as 80.4 ml/100 g.

From the above results, it has been clarified that, when the steel sheets are evaluated in terms of the two items, namely the capacity to prevent oxides from remaining and the magnetic property, the steel sheets under the conditions that the oil absorptions are from 1.0 to 70.0 ml/100 g are good.

(γRatio of Alumina)

It was found that, in order to produce a final-annealed sheet having a small amount of remaining oxides and not forming inorganic mineral films after final annealing, it was enough if alumina calcined at a calcination temperature of 900 to 1,400° C. was used, or it was enough if alumina having a BET specific surface area, which was used as an indicator for controlling and evaluating the alumina for use, of 1 to 100 $m^2/g$, was used. In addition, it was also understood that it was enough if alumina having an oil absorption, which was used as a simpler evaluation index, of 1 to 70 ml/100 g, was used.

The present inventors investigated the dependence of a capacity to prevent oxides from remaining on a γ (gamma) ratio of alumina for the purpose of clarifying the mechanisms of the dependence of a capacity to prevent oxides from remaining on a calcination temperature, a BET specific surface area and an oil absorption of alumina.

The present inventors carried out the following test and examined the relationship among a γ ratio of alumina, a capacity thereof to prevent oxides from remaining and a magnetic property of a steel sheet.

As test pieces, steel sheets 0.225 mm in thickness, after being subjected to decarburization annealing, were coated with annealing separator consisting mainly of alumina and they were subjected to final annealing for secondary recrystallization. At this time, 8 different kinds of alumina powder having γ ratios ranging from 0 to 3.2 were prepared in the form of water slurry and the steel sheets were coated with the slurry and dried.

A γ ratio mentioned here is the ratio of the diffraction intensity from the (440) plane of γ-alumina to the diffraction intensity from the (113) plane of α-alumina in the measurement of alumina powder by X-ray diffraction method. In the measurement using K α of Cu by the present inventors, the observed values of the peaks ascribed to α-alumina and γ-alumina agreed well with standard values of the references as explained below. Therefore, a γ ratio was obtained by measuring the intensities of these diffraction patterns and calculating the γ ratio.

A high γ ratio is considered to mean a loose alumina structure.

The diffraction peaks derived from α-alumina agreed well with that specified in Card No. 10-173 of the Joint Committee on Powder Diffraction Standards (JCPDS). Therefore, the diffraction peaks of 2.086 Å in distance and of 43.3 degrees in 2θ was identified as the diffraction peak from the (113) plane of α-alumina, and the intensity thereof was read from the chart. Also, the diffraction peak of γ-alumina agreed well with that specified in Card No. 29-63 of the JCPDS. Therefore, the diffraction peak of 1.40 Å in distance and of 66.8 degrees in 2θ was identified as the diffraction intensity from the (440) plane of γ-alumina, and the intensity thereof was read from the chart.

Then, the steel sheets were subjected to final annealing at 1,200° C. for 20 h. in a dry hydrogen atmosphere. The annealed steel sheets were cleaned of superfluous alumina remaining on the surfaces by wiping the surfaces with waste cloth in running water. The steel sheets thus prepared were analyzed and evaluated. Table 4 shows the results.

Note that the analysis method and the evaluation criteria were the same as those employed when the dependence of a capacity to prevent oxides from remaining on a calcination temperature of alumina was examined.

TABLE 4

Relationship of γ ratio of alumina with capacity to prevent oxides from remaining and magnetic property

| Condition number | γ ratio of alumina used (–) | Capacity to prevent oxides from remaining: Oxygen amount of final-annealed steel sheet (ppm) | Capacity to prevent oxides from remaining: Evaluation | Magnetic property: Flux density: B8 (T) | Magnetic property: Evaluation | Overall evaluation |
|---|---|---|---|---|---|---|
| 1 | 0 | 324 | X | 1.92 | Δ | X |
| 2 | 0.001 | 45 | ○ | 1.96 | ○ | ○ |
| 3 | 0.01 | 68 | ○ | 1.95 | ○ | ○ |
| 4 | 0.1 | 47 | ○ | 1.95 | ○ | ○ |
| 5 | 0.5 | 53 | ○ | 1.96 | ○ | ○ |
| 6 | 1.3 | 41 | ○ | 1.95 | ○ | ○ |
| 7 | 2.0 | 64 | ○ | 1.94 | ○ | ○ |
| 8 | 3.2 | 520 | X | 1.88 | X | ○ |

In Table 4, the steel sheets showing the high capacities to prevent oxides from remaining, namely having small amounts of remaining oxides on the steel sheet surfaces after final annealing, were the ones having the condition numbers 2 to 7 wherein the γ ratios were from 0.001 to 2.0. In case of the condition number 1 wherein the γ ratio was 0, the amount of remaining oxides was as high as 324 ppm in terms of the oxygen amount. In contrast, in case of the condition number 8 wherein the γ ratio was as high as 3.2, the amount of remaining oxides was as high as 520 ppm in terms of the oxygen amount, showing the low capacity to prevent oxides from remaining.

With respect to a magnetic property, whereas the flux densities were as good as 1.94 T or more in case of the condition numbers 2 to 7 wherein the γ ratios were from 0.001 to 2.0, the flux density was 1.92 T which was somewhat low in case of the condition number 1 wherein the γ ratio was 0, and, in contrast, the flux density was 1.88 T, which was very low and poor, in case of the condition number 8 wherein the γ ratio was as high as 3.2.

From the above results, it has been clarified that, when the steel sheets are evaluated in terms of the two items, namely the capacity to prevent oxides from remaining and the magnetic property, the steel sheets under the conditions that the γ ratios are from 0.001 to 2.0 are good.

(Mechanism of Alumina-Dependence)

The mechanisms by which a capacity to prevent oxides from remaining and a magnetic property depend on the properties of alumina are considered to be as follows.

In the first place, the relationship between a capacity to prevent oxides from remaining and a BET specific surface area is explained.

The present inventors prepared the water slurry of alumina having various BET specific surface areas, coated the steel sheets after being subjected to decarburization annealing with the slurry, dried them, subjected them to final annealing, and then examined the appearances of the surfaces thereof. Among the steel sheets, whereas, in case of those prepared by using alumina having the BET specific surface areas of 1.0 to 100.0 $m^2/g$, only small amounts of residues were observed on the surfaces, in case of a steel sheet prepared by using alumina having the small BET specific surface area of 0.6 $m^2/g$, observed were hemispherical deposits and substances formed by sticking alumina powder as if the hemispherical deposits acted as binders on the surfaces of the steel sheet. The photograph is shown in FIG. 1. Among the deposits having this appearance, the hemispherical deposits consist mainly of silica and, for this reason, it is considered that an oxide layer formed during the decarburization annealing generates a kind of aggregation reaction at a high temperature, and, as a result, the hemispherical deposits are formed. Generally speaking, an aggregation reaction does not proceed unless the substance is softened to some extent. Therefore, considering that the spherical objects are observed, it is appropriate to judge that a sort of softening has occurred. It is deduced that, when a softening reaction of silica takes place, and if it is possible to transfer the softened silica from a steel sheet surface to an annealing separator, namely alumina, the sticking of alumina caused by silica will not take place. In this regard, in consideration of the relationship between the amount of remaining oxides and the BET specific surface area of alumina explained earlier, the present inventors assumed the following mechanism occurs: in the case of alumina having a small BET specific surface area, the alumina cannot absorb silica in a molten-like state into its own structure owing to the small surface area, leaving the silica on the steel sheet surfaces and leading to the sticking of alumina; and, in the case of alumina having a large BET specific surface area, on the contrary, it can absorb silica into its own structure owing to the large surface area, and thus the sticking of alumina is inhibited. In the analysis of the oxygen amount of a steel sheet, what is measured in terms of the oxygen amount is the oxygen in the hemispherical silica and alumina. For this reason, by using alumina having a BET specific surface area of 1 to 100 $m^2/g$ as an annealing separator, it is possible to reduce the amount of oxides remaining on the steel sheet surfaces.

It is conjectured that, when a BET specific surface area exceeds 100 $m^2/g$, a hydration reaction proceeds to a measurable extent during the preparation of water slurry, the resultant water is discharged during final annealing and oxidizes a steel sheet, and, as a result, the amount of remaining oxides increases.

With regard to an oil absorption and a γ ratio too, like a BET specific surface area, it is estimated that the capacity of alumina to absorb softened and aggregated silica can be evaluated from an oil absorption, which is an index of the capacity to absorb linseed oil, or a γ ratio, which is an index of the looseness to absorb other substances into the crystal.

In the next place, the relationship between a magnetic property and a BET specific surface area is explained.

When a BET specific surface area is within the range from 1.0 to 100.0 $m^2/g$, a magnetic property is good, which is the same trend as the amount of remaining oxides. When a BET specific surface area is lower than the above range, however, a magnetic flux density deteriorates a little. This is presumably because a magnetic permeability deteriorates because the oxides remaining on a surface are non-magnetic. On the other hand, when a BET specific surface area exceeds the above range, a magnetic flux density deteriorates too. This is presumably because, when alumina has a large surface area, alumina is hydrated during the preparation of water slurry, the resultant water is discharged during final annealing and influences the secondary recrystallization reaction, and the secondary recrystallization reaction does not proceed desirably.

The present inventors presume that similar mechanisms work regarding the dependence of a magnetic property on an oil absorption or a γ ratio.

When alumina has too low an oil absorption or too low a γ ratio, it is presumed that a magnetic permeability deteriorates and a magnetic flux density also deteriorates as the oxides remaining on a surface are non-magnetic.

When an oil absorption or a γ ratio is too high, on the other hand, alumina is hydrated during the preparation of water slurry, the resultant water is discharged during final annealing and influences the secondary recrystallization reaction, the secondary recrystallization reaction does not proceed desirably, and a magnetic flux density deteriorates.

(Mixing of Magnesia)

The present inventors proceeded with studies further and tackled also the reduction of inclusions, which influence a core loss, in a steel. During the course of the studies, they found out the fact that, when magnesia was mixed with alumina while the BET specific surface areas of them were changed variously, the amounts of residual inclusions varied significantly with the change of their BET specific surface areas.

The present inventors carried out the following test and examined the relationship between the BET specific surface areas of alumina and magnesia and the amounts of oxides remaining on a surface and inclusions in a steel.

As test pieces, steel sheets 0.225 mm in thickness, after being subjected to decarburization annealing, were used and they were coated with annealing separator, consisting mainly of alumina and magnesia and then were subjected to final annealing. At this time, the mixtures of alumina and magnesia having various BET specific surface areas shown in Table 5 were prepared in the form of water slurry and the steel sheets were coated with the slurry and then dried. The weight percentage of the magnesia relative to the total weight of the alumina and magnesia was 20%.

Then, the steel sheets were subjected to final annealing at 1,200° C. for 20 h. in a dry hydrogen atmosphere. The annealed steel sheets were cleaned of the annealing separator remaining on the surfaces by wiping the surfaces with waste cloth in running water. The steel sheets thus prepared were analyzed and evaluated. Table 5 shows the results.

The degree of the effect of preventing oxides from remaining was evaluated with the amount of oxygen of a final-annealed sheet determined by chemical analysis. The evaluation criterion was defined as follows: a steel sheet showing an oxygen amount of 100 ppm or more was marked with X, and that showing an oxygen amount below 100 ppm was marked with ○.

The existence or not of inclusions in a steel immediately under a surface was judged as follows: a final-annealed sheet was immersed in a 5-volume % nitric acid solution at 20° C. for 40 sec. to remove the metallic phase in the surface layer in the range from the surface to the depth of several micrometers of the steel sheet by pickling; and inclusions insoluble to nitric acid and thus exposed to the pickled surface were observed with a scanning electron microscope. A steel sheet in which inclusions were found clearly was evaluated by the mark X, that in which a very small number of dispersed inclusions were found was evaluated by the mark Δ, and that in which no inclusions were found was evaluated by the mark ○.

TABLE 5

Amount of surface oxides and existence or not of inclusions in steel when alumina-magnesia type annealing separator is used in annealing

| Condition number | BET specific surface area: Alumina ($m^2/g$) | BET specific surface area: Magnesia ($m^2/g$) | Amount of surface oxides: Oxygen amount of steel sheet (ppm) | Amount of surface oxides: Evaluation | Existence or not of inclusions in steel: Existence or not of inclusions (SEM observation) | Existence or not of inclusions in steel: Evaluation | Overall evaluation |
|---|---|---|---|---|---|---|---|
| 1 | 0.3 | 0.5 | 298 | X | Existed | X | X |
| 2 | | 1.2 | 285 | X | " | X | X |
| 3 | | 5.0 | 283 | X | " | X | X |
| 4 | | 10.1 | 446 | X | " | X | X |
| 5 | 1.0 | 0.5 | 84 | ○ | Not existed | ○ | ○ |
| 6 | | 1.2 | 82 | ○ | " | ○ | ○ |
| 7 | | 5.0 | 76 | ○ | " | ○ | ○ |
| 8 | | 10.1 | 358 | X | Existed | X | X |
| 9 | 5.2 | 0.5 | 65 | ○ | Not existed | ○ | ○ |
| 10 | | 1.2 | 50 | ○ | " | ○ | ○ |
| 11 | | 5.0 | 58 | ○ | " | ○ | ○ |
| 12 | | 10.1 | 236 | X | Existed | X | X |
| 13 | 10.5 | 0.5 | 56 | ○ | Not existed | ○ | ○ |
| 14 | | 1.2 | 40 | ○ | " | ○ | ○ |
| 15 | | 5.0 | 49 | ○ | " | ○ | ○ |
| 16 | | 10.1 | 295 | X | Existed | X | X |
| 17 | 100.0 | 0.5 | 73 | ○ | Not existed | ○ | ○ |
| 18 | | 1.2 | 65 | ○ | " | ○ | ○ |
| 19 | | 5.0 | 72 | ○ | " | ○ | ○ |
| 20 | | 10.1 | 327 | X | Existed | X | X |

TABLE 5-continued

| Condition number | BET specific surface area: Alumina ($m^2/g$) | BET specific surface area: Magnesia ($m^2/g$) | Amount of surface oxides: Oxygen amount of steel sheet (ppm) | Amount of surface oxides: Evaluation | Existence or not of inclusions in steel: Existence or not of inclusions (SEM observation) | Existence or not of inclusions in steel: Evaluation | Overall evaluation |
|---|---|---|---|---|---|---|---|
| 21 | 212.8 | 0.5 | 126 | X | Existed slightly | Δ | X |
| 22 | | 1.2 | 174 | X | " | Δ | X |
| 23 | | 5.0 | 198 | X | " | Δ | X |
| 24 | | 10.1 | 350 | X | Existed | X | X |

Amount of surface oxides and existence or not of inclusions in steel when alumina-magnesia type annealing separator is used in annealing The results are explained, first, with respect to alumina.

From Table 5, in case of the condition numbers 1 to 4 wherein the BET specific surface areas of alumina were 0.3 $m^2/g$, the oxygen amounts of the steel sheets were large and inclusions were formed regardless of the BET specific surface areas of magnesia, and thus the steel sheets were evaluated as poor. Likewise, in case of the condition numbers 21 to 24 wherein the BET specific surface areas of alumina were 212.8 $m^2/g$, the oxygen amounts of the steel sheets exceeded 100 ppm and inclusions existed, though in a limited quantity, regardless of the BET specific surface areas of magnesia, and thus the steel sheets were evaluated as poor. In the cases where the BET specific surface areas of alumina were in the range from 1.0 to 100 $m^2/g$, there were some cases where the oxygen amounts of the steel sheets were below 100 ppm and no inclusions in the steels were formed, depending on the BET specific surface areas of magnesia. From the above, with regard to alumina, the condition that a BET specific surface area of alumina is in the range from 1.0 to 100 $m^2/g$, is essential.

Then, the test results are explained with respect to magnesia.

Among the cases of the condition numbers 5 to 20 wherein the BET specific surface areas of alumina were in the range from 1.0 to 100.0 $m^2/g$, in case of the condition numbers 8, 12, 16 and 20 wherein the BET specific surface areas of the mixed magnesia were 10.1 $m^2/g$, the oxygen amounts of the steel sheets were large and inclusions in the steels were formed, and thus the steel sheets were evaluated as poor. On the other hand, in the cases where the BET specific surface areas of the mixed magnesia were in the range from 0.5 to 5.0 $m^2/g$, the oxygen amounts of the steel sheets were not more than 100 ppm and no inclusions in the steels were formed, and thus the steel sheets were evaluated as good.

From the above results, it has been clarified that, when the steel sheets are evaluated in terms of the two items, namely the oxides remaining on a surface and the formation of inclusions in a steel, a final-annealed sheet having the small amounts of oxides remaining on a surface and no inclusions in the steel can be obtained by using an annealing separator consisting mainly of alumina having a BET specific surface area of 1 to 100 $m^2/g$ and being mixed with magnesia having a BET specific surface area of 0.5 to 5.0 $m^2/g$.

Next, the present inventors examined the influence of the ratio of the weight of mixed magnesia to the total weight of alumina and magnesia. As test pieces, steel sheets 0.225 mm in thickness, after being subjected to decarburization annealing, were used, and they were coated with annealing separator consisting mainly of alumina and magnesia and dried. At this time, alumina having a BET specific surface area of 10.5 $m^2/g$ and magnesia having a BET specific surface area of 1.2 $m^2/g$ were used. Then, the steel sheets coated with annealing separator were subjected to final annealing at 1,200° C. for 20 h. in a dry hydrogen atmosphere. The annealed steel sheets were cleaned of the annealing separator on the surfaces by wiping the surfaces with waste cloth in running water. The steel sheets thus prepared were analyzed and evaluated. Table 6 shows the results. Note that the analysis and evaluation were carried out in the same manner as that shown in Table 1.

TABLE 6

| Condition number | Mixing ratio: Alumina (weight %) | Mixing ratio: Magnesia (weight %) | Amount of remaining oxides: Oxygen amount of steel sheet (ppm) | Amount of remaining oxides: Evaluation | Formation of inclusion: Existence or not of inclusions (SEM observation) | Formation of inclusion: Evaluation | Overall evaluation |
|---|---|---|---|---|---|---|---|
| 1 | 99 | 1 | 90 | ○ | Existed | X | Δ |
| 2 | 95 | 5 | 83 | ○ | Not existed | ○ | ○ |
| 3 | 90 | 10 | 73 | ○ | " | ○ | ○ |
| 4 | 80 | 20 | 51 | ○ | " | ○ | ○ |
| 5 | 70 | 30 | 71 | ○ | " | ○ | ○ |

Influence of magnesia mixing ratio in alumina-magnesia type annealing separator

TABLE 6-continued

Influence of magnesia mixing ratio in alumina-magnesia type annealing separator

| Condition number | Mixing ratio: Alumina (weight %) | Mixing ratio: Magnesia (weight %) | Amount of remaining oxides: Oxygen amount of steel sheet (ppm) | Amount of remaining oxides: Evaluation | Formation of inclusion: Existence or not of inclusions (SEM observation) | Formation of inclusion: Evaluation | Overall evaluation |
|---|---|---|---|---|---|---|---|
| 6 | 50 | 50 | 340 | X | Glass films formed | X | X |

In Table 6, in the case where the mixing ratio of magnesia was 1%, while the oxygen amount of the steel sheet was as low as 90 ppm, inclusions were observed and the steel sheet was evaluated as poor. In the case where the mixing ratio of magnesia was 50%, the oxygen amount of the steel sheet was as high as 340 ppm and the so-called glass film consisting mainly of forsterite was formed and, as a result, the steel sheet was evaluated as poor. On the other hand, in the cases where the mixing ratios of magnesia were within the range from 5 to 30%, the oxygen amounts of the steel sheets were as low as 100 ppm or less, namely the amounts of the remaining oxides were low, no inclusions were observed, and, as a result, the steel sheets were evaluated as good.

From the above, it has been clarified that a mixing ratio of magnesia has to be in the range from 5 to 30 mass %.

With regard to the mechanisms by which a final-annealed sheet having the small amounts of oxides on a surface and inclusions in the steel can be produced by mixing magnesia having a BET specific surface area of 0.5 to 5.0 $m^2/g$ with annealing separator consisting mainly of alumina having a BET specific surface area of 1 to 100 $m^2/g$ in a mixing ratio of 5 to 30 mass % as stated above, the present inventors think as follows.

The relationship between a BET specific surface area of alumina and an amount of oxides remaining on a surface is as explained earlier.

With regard to the role of magnesia, the present inventors assumed as follows. The aggregates of hemispherical silica were discussed earlier. When the aggregates are formed on a surface of a steel sheet, there arises a situation in which even the alumina having a large BET specific surface area cannot absorb the aggregates completely. Regarding the above, the present inventors conjecture that, if magnesia coexists with alumina, magnesia may react in some way or other with the aggregates of molten-like silica not completely absorbed by alumina itself, changing them into a compound easily removable from a surface of a steel sheet. They suppose further that, when a mixing ratio of magnesia is below 5 mass %, the above effect hardly shows up and, when the mixing ratio exceeds 30 mass %, on the other hand, a forsterite film uniformly forms on a steel sheet surface and that causes the amounts of oxides on the surface and inclusions in the steel to increase. The lower limit of the BET specific surface area of magnesia is not clear as yet. As for the upper limit, the present inventors suppose that, when a BET specific surface area of magnesia is large, the activity of magnesia in the form of powder increases excessively, as a consequence, the same effect as in the case where magnesia is mixed at a high mixing ratio is brought about, a film similar to that of forsterite is formed, and that causes the amounts of oxides on the surface and inclusions in the steel to increase.

Regarding the grain sizes of alumina and magnesia used for an annealing separator, in view of the fact that the thickness of a common grain-oriented silicon steel sheet is from 0.225 to 0.50 mm, it is desirable that the median grain sizes are 200 $\mu$m or less in consideration of the stacking factor obtained when the steel sheet is coated with an annealing separator, dried, and wound into a coil.

If there is a concern about the insufficient adhesiveness of an annealing separator to a steel sheet or if there occurs a problem in the settling of the slurry, a thickener or the like may be added as required. Further, even if calcium oxide or the like is added for accelerating the purification of the sulfur component in a steel, it does not hinder the effects of the present invention.

It must be noted that, though Japanese Unexamined Patent Publication No. S59-96278 mentioned earlier discloses a method in which inert magnesia calcined at a temperature of 1,300° C. or above and crushed and thus having a specific surface area in the range from 0.5 to 10 $m^2/g$ is added by 15 to 70 to alumina of 100 in terms of weight, this is a technology different from that of the present invention for the following reasons. In the first place, whereas the present invention specifies the BET specific surface area of alumina as an important factor, no specification of it is provided in said patent. In addition, whereas the object of mixing magnesia in the present invention is to change the molten-like silica aggregates into a compound easily removable from a surface of a steel sheet, the object of mixing magnesia in said patent is to remove S and Se used as inhibitors and, thus, the objects of mixing magnesia are totally different.

EXAMPLE

Example 1

Cold-rolled steel sheets 0.30 mm in thickness having a Si concentration of 3.30% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one calcined at 1,500° C. (comparative example) and the other at 1,200° C. (invented example). The steel sheets after the final annealing were rinsed with water and the oxygen amounts and magnetic properties were evaluated. The results are shown in Table 7.

TABLE 7

| Relationship of calcination temperature of alumina with capacity to prevent oxides from remaining and magnetic property | | | | | | |
|---|---|---|---|---|---|---|
| | Capacity to prevent oxides from remaining | | Magnetic property | | | |
| Calcination temperature of alumina powder (° C.) | Oxygen amount of final-annealed steel sheet (ppm) | Evaluation | Flux density: B8 (T) | Evaluation | Overall evaluation | Remarks |
| 1500 | 450 | X | 1.91 | Δ | X | Comparative example |
| 1200 | 25 | ○ | 1.95 | ○ | ○ | Invented example |

In Table 7, in case of the comparative example wherein the calcination temperature of alumina was as high as 1,500° C., the oxygen amount of the final-annealed steel sheet was as high as 450 ppm showing a poor capacity to prevent oxides from remaining, the magnetic flux density was 1.91 T which was somewhat low, and the example was rated as poor. In contrast, in case of the invented example wherein the calcination temperature of alumina was 1,200° C., the oxygen amount of the final-annealed steel sheet was as low as 25 ppm showing a good capacity to prevent oxides from remaining, the magnetic flux density was as high as 1.95 T, and the example was rated as good.

Example 2

Cold-rolled steel sheets 0.225 mm in thickness having a Si concentration of 3.20% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one calcined at 800° C. (comparative example) and the other at 1,100° C. (invented example). The steel sheets after the final annealing were rinsed with water and the oxygen amounts and magnetic properties were evaluated. The results are shown in Table 8.

TABLE 8

| Relationship of calcination temperature of alumina with capacity to prevent oxides from remaining and magnetic property | | | | | | |
|---|---|---|---|---|---|---|
| | Capacity to prevent oxides from remaining | | Magnetic property | | | |
| Calcination temperature of alumina powder (° C.) | Oxygen amount of final-annealed steel sheet (ppm) | Evaluation | Flux density: B8 (T) | Evaluation | Overall evaluation | Remarks |
| 800 | 220 | X | 1.88 | X | X | Comparative example |
| 1100 | 32 | ○ | 1.94 | ○ | ○ | Invented example |

In Table 8, in case of the comparative example wherein the calcination temperature of alumina was as low as 800° C., the oxygen amount of the final-annealed steel sheet was as high as 528 ppm showing a poor capacity to prevent oxides from remaining, the magnetic flux density was as low as 1.88 T, and the example was rated as poor. In contrast, in case of the invented example wherein the calcination temperature of alumina was 1,100° C., the oxygen amount of the final-annealed steel sheet was as low as 32 ppm showing a good capacity to prevent oxides from remaining, the magnetic flux density was as high as 1.94 T, and the example was rated as good.

Example 3

Cold-rolled steel sheets 0.15 mm in thickness having a Si concentration of 3.25% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one calcined at 500° C. (comparative example) and the other at 1,300° C. (invented example). The steel sheets after the final annealing were rinsed with water and the oxygen amounts and magnetic properties were evaluated. The results are shown in Table 9.

TABLE 9

| Relationship of calcination temperature of alumina with capacity to prevent oxides from remaining and magnetic property | | | | | | |
|---|---|---|---|---|---|---|
| | Capacity to prevent oxides from remaining | | Magnetic property | | | |
| Calcination temperature of alumina powder (° C.) | Oxygen amount of final-annealed steel sheet (ppm) | Evaluation | Flux density: B8 (T) | Evaluation | Overall evaluation | Remarks |
| 500 | 765 | X | 1.80 | X | X | Comparative example |
| 1300 | 43 | ○ | 1.94 | ○ | ○ | Invented example |

In Table 9, in case of the comparative example wherein the calcination temperature of alumina was as low as 500° C., the oxygen amount of the final-annealed steel sheet was as high as 765 ppm showing a poor capacity to prevent oxides from remaining, the magnetic flux density was as low as 1.80 T, and the example was rated as poor. In contrast, in the case of the invented example wherein the calcination temperature of alumina was 1,300° C., the oxygen amount of the final-annealed steel sheet was as low as 43 ppm showing a good capacity to prevent oxides from remaining, the magnetic flux density was as high as 1.94 T, and the example was rated as good.

Example 4

Cold-rolled steel sheets 0.225 mm in thickness having a Si concentration of 3.25% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one having a BET specific surface area of 0.4 $m^2/g$ (comparative example) and the other having a BET specific surface area of 7.8 $m^2/g$ (invented example). The steel sheets after the final annealing were rinsed with water and the oxygen amounts and magnetic properties were evaluated. The results are shown in Table 10.

TABLE 10

| Relationship of BET specific surface area of alumina with capacity to prevent oxides from remaining and magnetic property | | | | | | |
|---|---|---|---|---|---|---|
| | Capacity to prevent oxides from remaining | | Magnetic property | | | |
| BET specific surface area of alumina powder ($m^2/g$) | Oxygen amount of final-annealed steel sheet (ppm) | Evaluation | Flux density: B8 (T) | Evaluation | Overall evaluation | Remarks |
| 0.4 | 420 | X | 1.92 | Δ | X | Comparative example |
| 7.8 | 40 | ○ | 1.95 | ○ | ○ | Invented example |

In Table 10, in case of the comparative example wherein the BET specific surface area was as small as 0.4 $m^2/g$, the oxygen amount of the final-annealed steel sheet was as high as 420 ppm showing a poor capacity to prevent oxides from remaining, the magnetic flux density was 1.92 T which was somewhat low, and the example was rated as poor. In contrast, in case of the invented example wherein the BET specific surface area was as large as 7.8 $m^2/g$, the oxygen amount of the final-annealed steel sheet was as low as 40 ppm showing a good capacity to prevent oxides from remaining, the magnetic flux density was as high as 1.95 T, and the example was rated as good.

Example 5

Cold-rolled steel sheets 0.30 mm in thickness having a Si concentration of 3.35% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one having a BET specific surface area of 0.8 $m^2/g$ (comparative example) and the other having a BET specific surface area of 23.2 $m^2/g$ (invented example). The steel sheets after the final annealing were rinsed with water and the oxygen amounts and magnetic properties were evaluated. The results are shown in Table 11.

TABLE 11

| Relationship of BET specific surface area of alumina with capacity to prevent oxides from remaining and magnetic property | | | | | | |
|---|---|---|---|---|---|---|
| BET specific surface area of alumina powder ($m^2/g$) | Capacity to prevent oxides from remaining: Oxygen amount of final-annealed steel sheet (ppm) | Evaluation | Magnetic property: Flux density: B8 (T) | Evaluation | Overall evaluation | Remarks |
| 0.8 | 210 | X | 1.92 | Δ | X | Comparative example |
| 23.2 | 28 | ○ | 1.96 | ○ | ○ | Invented example |

In Table 11, in case of the comparative example wherein the BET specific surface area was as small as 0.8 $m^2/g$, the oxygen amount of the final-annealed steel sheet was as high as 210 ppm showing a poor capacity to prevent oxides from remaining, the magnetic flux density was 1.92 T which was somewhat low, and the example was rated as poor. In contrast, in case of the invented example wherein the BET specific surface area was as large as 23.2 $m^2/g$, the oxygen amount of the final-annealed steel sheet was as low as 28 ppm showing a good capacity to prevent oxides from remaining, the magnetic flux density was as high as 1.96 T, and the example was rated as good.

Example 6

Cold-rolled steel sheets 0.15 mm in thickness having a Si concentration of 3.20% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one having a BET specific surface area of 0.7 $m^2/g$ (comparative example) and the other having a BET specific surface area of 15.7 $m^2/g$ (invented example). The steel sheets after the final annealing were rinsed with water and the oxygen amounts and magnetic properties were evaluated. The results are shown in Table 12.

TABLE 12

| Relationship of BET specific surface area of alumina with capacity to prevent oxides from remaining and magnetic property | | | | | | |
|---|---|---|---|---|---|---|
| BET specific surface area of alumina powder ($m^2/g$) | Capacity to prevent oxides from remaining: Oxygen amount of final-annealed steel sheet (ppm) | Evaluation | Magnetic property: Flux density: B8 (T) | Evaluation | Overall evaluation | Remarks |
| 0.7 | 630 | X | 1.91 | Δ | X | Comparative example |
| 15.7 | 52 | ○ | 1.95 | ○ | ○ | Invented example |

In Table 12, in case of the comparative example wherein the BET specific surface area was as small as 0.7 $m^2/g$, the oxygen amount of the final-annealed steel sheet was as high as 630 ppm showing a poor capacity to prevent oxides from remaining, the magnetic flux density was 1.91 T which was somewhat low, and the example was rated as poor. In contrast, in case of the invented example wherein the BET specific surface area was as large as 15.7 $m^2/g$, the oxygen amount of the final-annealed steel sheet was as low as 52 ppm showing a good capacity to prevent oxides from remaining, the magnetic flux density was as high as 1.95 T, and the example was rated as good.

Example 7

Cold-rolled steel sheets 0.15 mm in thickness having a Si concentration of 3.25% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one having an oil absorption of 0.4 ml/100 g (comparative example) and the other having an oil absorption of 25.6 ml/100 g (invented example). The steel sheets after the final annealing were rinsed with water and the oxygen amounts and magnetic properties were evaluated. The results are shown in Table 13.

TABLE 13

| Relationship of oil absorption of alumina with capacity to prevent oxides from remaining and magnetic property | | | | | | |
|---|---|---|---|---|---|---|
| Oil absorption of alumina powder (ml/100 g) | Capacity to prevent oxides from remaining: Oxygen amount of final-annealed steel sheet (ppm) | Evaluation | Magnetic property: Flux density: B8 (T) | Evaluation | Overall evaluation | Remarks |
| 0.4 | 650 | X | 1.92 | Δ | X | Comparative example |
| 25.6 | 45 | ○ | 1.94 | ○ | ○ | Invented example |

In Table 13, in case of the comparative example wherein the oil absorption was as small as 0.4 ml/100 g, the oxygen amount of the final-annealed steel sheet was as high as 650 ppm showing a poor capacity to prevent oxides from remaining, the magnetic flux density was 1.92 T which was somewhat low, and the example was rated as poor. In contrast, in case of the invented example wherein the oil absorption was as large as 25.6 ml/100 g, the oxygen amount of the final-annealed steel sheet was as low as 45 ppm showing a good capacity to prevent oxides from remaining, the magnetic flux density was as high as 1.94 T, and the example was rated as good.

Example 8

Cold-rolled steel sheets 0.30 mm in thickness having a Si concentration of 3.30% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one having an oil absorption of 0.8 ml/100 g (comparative example) and the other having an oil absorption of 13.6 ml/100 g (invented example). The steel sheets after the final annealing were rinsed with water and the oxygen amounts and magnetic properties were evaluated. The results are shown in Table 14.

TABLE 14

| Relationship of oil absorption of alumina with capacity to prevent oxides from remaining and magnetic property | | | | | | |
|---|---|---|---|---|---|---|
| Oil absorption of alumina powder (ml/100 g) | Capacity to prevent oxides from remaining: Oxygen amount of final-annealed steel sheet (ppm) | Evaluation | Magnetic property: Flux density: B8 (T) | Evaluation | Overall evaluation | Remarks |
| 0.8 | 390 | X | 1.91 | Δ | X | Comparative example |
| 13.6 | 31 | ○ | 1.95 | ○ | ○ | Invented example |

In Table 14, in case of the comparative example wherein the oil absorption was as small as 0.8 ml/100 g, the oxygen amount of the final-annealed steel sheet was as high as 390 ppm showing a poor capacity to prevent oxides from remaining, the magnetic flux density was 1.91 T which was somewhat low, and the example was rated as poor. In contrast, in case of the invented example wherein the oil absorption was as large as 13.6 ml/100 g, the oxygen amount of the final-annealed steel sheet was as low as 31 ppm showing a good capacity to prevent oxides from remaining, the magnetic flux density was as high as 1.95 T, and the example was rated as good.

Example 9

Cold-rolled steel sheets 0.225 mm in thickness having a Si concentration of 3.35% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one having an oil absorption of 0.3 ml/100 g (comparative example) and the other having an oil absorption of 57.6 ml/100 g (invented example). The steel sheets after the final annealing were rinsed with water and the oxygen amounts and magnetic properties were evaluated. The results are shown in Table 15.

TABLE 15

| Relationship of oil absorption of alumina with capacity to prevent oxides from remaining and magnetic property | | | | | | |
|---|---|---|---|---|---|---|
| BET specific Oil absorption of alumina powder (ml/100 g) | Capacity to prevent oxides from remaining: Oxygen amount of final-annealed steel sheet (ppm) | Evaluation | Magnetic property: Flux density: B8 (T) | Evaluation | Overall evaluation | Remarks |
| 0.3 | 450 | X | 1.92 | Δ | X | Comparative example |
| 57.6 | 50 | ○ | 1.96 | ○ | ○ | Invented example |

In Table 15, in case of the comparative example wherein the oil absorption was as small as 0.3 ml/100 g, the oxygen amount of the final-annealed steel sheet was as high as 450 ppm showing a poor capacity to prevent oxides from remaining, the magnetic flux density was 1.92 T which was somewhat low, and the example was rated as poor. In contrast, in case of the invented example wherein the oil absorption was as large as 57.6 ml/100 g, the oxygen amount of the final-annealed steel sheet was as low as 50 ppm showing a good capacity to prevent oxides from remaining, the magnetic flux density was as high as 1.96 T, and the example was rated as good.

Example 10

Cold-rolled steel sheets 0.30 mm in thickness having a Si concentration of 3.30% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one having a γ ratio of 2.8 (comparative example) and the other having a γ ratio of 0.001 (invented example). The steel sheets after the finish annealing were rinsed with water and the oxygen amounts and magnetic properties were evaluated. The results are shown in Table 16.

TABLE 16

| Relationship of γ ratio of alumina with capacity to prevent oxides from remaining and magnetic property | | | | | | |
|---|---|---|---|---|---|---|
| γ ratio of alumina powder (–) | Capacity to prevent oxides from remaining: Oxygen amount of final-annealed steel sheet (ppm) | Evaluation | Magnetic property: Flux density: B8 (T) | Evaluation | Overall evaluation | Remarks |
| 2.8 | 382 | X | 1.89 | X | X | Comparative example |
| 0.001 | 33 | ○ | 1.94 | ○ | ○ | Invented example |

In Table 16, in case of the comparative example wherein the γ ratio was 2.8, the oxygen amount of the final-annealed steel sheet was as high as 382 ppm showing a poor capacity to prevent oxides from remaining, the magnetic flux density was as low as 1.89 T, and the example was rated as poor. In contrast, in case of the invented example wherein the γ ratio was 0.001, the oxygen amount of the final-annealed steel sheet was as low as 33 ppm showing a good capacity to prevent oxides from remaining, the magnetic flux density was as high as 1.94 T, and the example was rated as good.

Example 11

Cold-rolled steel sheets 0.15 mm in thickness having a Si concentration of 3.25% and being used for producing grain-oriented silicon steel sheets were subjected to decarburization annealing, coated with alumina powder prepared in the form of water slurry, dried, and then final-annealed at 1,200°

C. for 20 h. in a dry hydrogen atmosphere. Two kinds of alumina powder were used here: one having a γ ratio of 3.4 (comparative example) and the other having a γ ratio of 0.01 (invented example). The steel sheets after the final annealing were rinsed with water and the oxygen amounts and magnetic properties were evaluated. The results are shown in Table 17.

TABLE 17

| Relationship of γ ratio of alumina with capacity to prevent oxides from remaining and magnetic property | | | | | | |
|---|---|---|---|---|---|---|
| | Capacity to prevent oxides from remaining | | Magnetic property | | | |
| γ ratio of alumina powder (–) | Oxygen amount of final-annealed steel sheet (ppm) | Evaluation | Flux density: B8 (T) | Evaluation | Overall evaluation | Remarks |
| 3.4 | 631 | X | 1.88 | X | X | Comparative example |
| 0.01 | 43 | ○ | 1.95 | ○ | ○ | Invented example |

In Table 17, in case of the comparative example wherein the γ ratio was 3.4, the oxygen amount of the final-annealed steel sheet was as high as 631 ppm showing a poor capacity to prevent oxides from remaining, the magnetic flux density was as low as 1.88 T, and the example was rated as poor. In contrast, in case of the invented example wherein the γ ratio was 0.01, the oxygen amount of the final-annealed steel sheet was as low as 43 ppm showing a good capacity to prevent oxides from remaining, the magnetic flux density was as high as 1.95 T, and the example was rated as good.

Example 12

Cold-rolled steel sheets 0.225 mm in thickness having a Si concentration of 3.35% and being used for producing grain-oriented silicon steel sheets were subjected to decarburization annealing, coated with alumina powder prepared in the form of water slurry, dried, and then final-annealed at 1,200° C. for 20 h. in a dry hydrogen atmosphere. Two kinds of alumina powder were used here: one having a γ ratio of 4.1 (comparative example) and the other having a γ ratio of 0.2 (invented example). The steel sheets after the final annealing were rinsed with water and the oxygen amounts and magnetic properties were evaluated. The results are shown in Table 18.

TABLE 18

| Relationship of γ ratio of alumina with capacity to prevent oxides from remaining and magnetic property | | | | | | |
|---|---|---|---|---|---|---|
| | Capacity to prevent oxides from remaining | | Magnetic property | | | |
| γ ratio of alumina powder (–) | Oxygen amount of final-annealed steel sheet (ppm) | Evaluation | Flux density: B8 (T) | Evaluation | Overall evaluation | Remarks |
| 4.1 | 439 | X | 1.89 | X | X | Comparative example |
| 0.2 | 52 | ○ | 1.96 | ○ | ○ | Invented example |

In Table 18, in case of the comparative example wherein the γ ratio was 4.1, the oxygen amount of the final-annealed steel sheet was as high as 439 ppm showing a poor capacity to prevent oxides from remaining, the magnetic flux density was as low as 1.89 T, and the example was rated as poor. In contrast, in case of the invented example wherein the γ ratio was 0.2, the oxygen amount of the final-annealed steel sheet was as low as 52 ppm showing a good capacity to prevent oxides from remaining, the magnetic flux density was as high as 1.96 T, and the example was rated as good.

Example 13

Cold-rolled steel sheets 0.30 mm in thickness having a Si concentration of 3.30% and being used for producing grain-oriented silicon steel sheets were subjected to decarburization annealing, coated with a mixture of alumina powder and magnesia powder prepared in the form of water slurry, dried, and then final-annealed at 1,200° C. for 20 h. in a dry hydrogen atmosphere. Here, when the water slurry was prepared, the alumina powder having a BET specific surface area of 23.1 $m^2/g$ and the magnesia powder having a BET specific surface area of 2.4 $m^2/g$ were mixed in the mixing ratios shown in Table 19. The steel sheets after the final annealing were rinsed with water and the oxygen amounts and magnetic properties were evaluated. The results are shown in Table 19.

TABLE 19

| Mixing ratio, amount of remaining oxides and formation of inclusions when alumina-magnesia type annealing separator is used in annealing | | | | | | | | | | |
|---|---|---|---|---|---|---|---|---|---|---|
| | Composition of annealing separator | | | | Amount of remaining oxides | | Formation of inclusion | | | |
| | Alumina | | Magnesia | | Oxygen | | Existence or | | | |
| Condition number | BET specific surface area | Mass % | BET specific surface area | Mass % | amount of steel sheet (ppm) | Evaluation | not of inclusions (SEM observation) | Evaluation | Overall evaluation | Remarks |
| 1 | 23.1 | 99 | 2.4 | 1 | 85 | ○ | Existed | X | Δ | Comparative example |
| 2 | | 95 | | 5 | 63 | ○ | Not existed | ○ | ○ | Invented example |
| 3 | | 90 | | 10 | 53 | ○ | " | ○ | ○ | Invented example |
| 4 | | 60 | | 40 | 430 | X | Existed | X | X | Comparative example |

In Table 19 wherein annealing separator prepared by mixing the alumina having a BET specific surface area of 23.1 $m^2/g$ with the magnesia having a BET specific surface area of 2.4 $m^2/g$ were used, whereas, in case of the condition number 1 (comparative example) wherein the mixing ratio of the magnesia was 1 mass %, inclusions formed in spite that the oxygen amount of the steel sheet was as low as 85 ppm, and also, in case of the condition number 4 (comparative example) wherein the mixing ratio of the magnesia was 40 mass %, the amount of oxides remaining on the surfaces of the steel sheet was large and inclusions formed, in case of the condition numbers 2 and 3 (invented examples) wherein the mixing ratios of the magnesia were 5 and 10 mass %, respectively, the amounts of oxides remaining on the surfaces of the steel sheets were as low as 100 ppm or less and inclusions did not form and, as a result, the examples were rated as good.

Example 14

Cold-rolled steel sheets 0.15 mm in thickness having a Si concentration of 3.25% and being used for producing grain-oriented silicon steel sheets were subjected to decarburization annealing, coated with a mixture of alumina powder and magnesia powder prepared in the form of water slurry, dried, and then final-annealed at 1,200° C. for 20 h. in a dry hydrogen atmosphere. Here, when the water slurry was prepared, the alumina powder having a BET specific surface area of 7.6 $m^2/g$ and the magnesia powder having a BET specific surface area of 0.8 $m^2/g$ were mixed in the mixing ratios shown in Table 20. The steel sheets after the final annealing were rinsed with water and the oxygen amounts and magnetic properties were evaluated. The results are shown in Table 20.

TABLE 20

| Mixing ratio, amount of remaining oxides and formation of inclusions when alumina-magnesia type annealing separator is used in annealing | | | | | | | | | | |
|---|---|---|---|---|---|---|---|---|---|---|
| | Composition of annealing separator | | | | Amount of remaining oxides | | Formation of inclusion | | | |
| | Alumina | | Magnesia | | Oxygen | | Existence or | | | |
| Condition number | BET specific surface area | Mass % | BET specific surface area | Mass % | amount of steel sheet (ppm) | Evaluation | not of inclusions (SEM observation) | Evaluation | Overall evaluation | Remarks |
| 1 | 7.6 | 98 | 0.8 | 2 | 95 | ○ | Existed | X | Δ | Comparative example |
| 2 | | 95 | | 5 | 94 | ○ | Not existed | ○ | ○ | Invented example |
| 3 | | 85 | | 15 | 81 | ○ | " | ○ | ○ | Invented example |

TABLE 20-continued

| | Mixing ratio, amount of remaining oxides and formation of inclusions when alumina-magnesia type annealing separator is used in annealing | | | | | | | | | |
|---|---|---|---|---|---|---|---|---|---|---|
| | Composition of annealing separator | | | | Amount of remaining oxides | | Formation of inclusion | | | |
| | Alumina | | Magnesia | | Oxygen | | Existence or | | | |
| Condition number | BET specific surface area | Mass % | BET specific surface area | Mass % | amount of steel sheet (ppm) | Evaluation | not of inclusions (SEM observation) | Evaluation | Overall evaluation | Remarks |
| 4 | | 50 | | 50 | 394 | X | Existed | X | X | Comparative example |

In Table 20 wherein annealing separator prepared by mixing the alumina having a BET specific surface area of 7.6 $m^2/g$ with the magnesia having a BET specific surface area of 0.8 $m^2/g$ were used, whereas, in case of the condition number 1 (comparative example) wherein the mixing ratio of the magnesia was 2 mass %, inclusions were formed even though the oxygen amount of the steel sheet was as low as 95 ppm and, also, in case of the condition number 4 (comparative example) wherein the mixing ratio of the magnesia was 50 mass %, the amount of oxides remaining on the surfaces of the steel sheet was large and inclusions formed, in case of the condition numbers 2 and 3 (invented examples) wherein the mixing ratios of the magnesia were 5 and 15 mass %, respectively, the amounts of oxides remaining on the surfaces of the steel sheets were as low as 100 ppm or less and inclusions did not form and, as a result, the examples were rated as good.

Example 15

Cold-rolled steel sheets 0.225 mm in thickness having a Si concentration of 3.35% and being used for producing grain-oriented silicon steel sheets were subjected to decarburization annealing, coated with a mixture of alumina powder and magnesia powder prepared in the form of water slurry, dried, and then final-annealed at 1,200° C. for 20 h. in a dry hydrogen atmosphere. Here, when the water slurry was prepared, the alumina powder having a BET specific surface area of 14.5 $m^2/g$ and the magnesia powder having a BET specific surface area of 1.1 $m^2/g$ were mixed in the mixing ratios shown in Table 21. The steel sheets after the final annealing were rinsed with water and the oxygen amounts and magnetic properties were evaluated. The results are shown in Table 21.

TABLE 21

| | Mixing ratio, amount of remaining oxides and formation of inclusions when alumina-magnesia type annealing separator is used in annealing | | | | | | | | | |
|---|---|---|---|---|---|---|---|---|---|---|
| | Composition of annealing separator | | | | Amount of remaining oxides | | Formation of inclusion | | | |
| | Alumina | | Magnesia | | Oxygen | | Existence | | | |
| Condition number | BET specific surface area | Mass % | BET specific surface area | Mass % | amount of steel sheet (ppm) | Evaluation | or not of inclusions (SEM observation) | Evaluation | Overall evaluation | Remarks |
| 1 | 14.5 | 98 | 1.1 | 2 | 90 | ○ | Existed | X | Δ | Comparative example |
| 2 | | 90 | | 10 | 75 | ○ | Not existed | ○ | ○ | Invented example |
| 3 | | 80 | | 20 | 69 | ○ | " | ○ | ○ | Invented example |
| 4 | | 60 | | 40 | 271 | X | Existed | X | X | Comparative example |

In Table 21 wherein annealing separator prepared by mixing the alumina having a BET specific surface area of 14.5 $m^2/g$ with the magnesia having a BET specific surface area of 1.1 $m^2/g$ were used, whereas, in case of the condition number 1 (comparative example) wherein the mixing ratio of the magnesia was 2 mass %, inclusions formed in spite that the oxygen amount of the steel sheet was as low as 90 ppm, and also, in case of the condition number 4 (comparative example) wherein the mixing ratio of the magnesia was 40 mass %, the amount of oxides remaining on the surfaces of the steel sheet was large and inclusions formed, in case of the condition numbers 2 and 3 (invented examples) wherein the mixing ratios of the magnesia were 10 and 20 mass %, respectively, the amounts of oxides remaining on the surfaces of the steel sheets were as low as 100 ppm or less and inclusions did not form and, as a result, the examples were rated as good.

INDUSTRIAL APPLICABILITY

The present invention makes it possible to provide a grain-oriented silicon steel sheet not having inorganic mineral coating films on the surfaces by using an annealing separator capable of preventing the inorganic mineral films composed of forsterite ($Mg_2SiO_4$) and so on from forming during final annealing.

What is claimed is:

1. A method for producing a grain-oriented silicon steel sheet not having inorganic mineral films, comprising the steps of decarburization annealing followed by coating with an annealing separator and final annealing, wherein alumina powder calcined at a calcination temperature of 900 to 1,400° C. is used as the annealing separator.

2. A method for producing a grain-oriented silicon steel sheet not having inorganic mineral films, comprising the steps of decarburization annealing followed by coating with the annealing separator and final annealing, according to claim 1, wherein the alumina powder having a BET specific surface area of 1 to 100 $m^2/g$ is used as the annealing separator.

3. A method for producing a grain-oriented silicon steel sheet not having inorganic mineral films, comprising the steps of decrburization annealing followed by coating with the annealing separator and final annealing, according to claim 1, wherein the alumina powder having an oil absorption of 1 to 70 ml/100 g is used as the annealing separator.

4. A method for producing a grain-oriented silicon steel sheet not having inorganic mineral films, comprising the steps of decarburization annealing followed by coating with the annealing separator and final annealing, according to claim 1, wherein the alumina powder having a $\gamma$ ratio of 0.001 to 2.0 is used as the annealing separator, where the $\gamma$ ratio is the ratio of the diffraction intensity from the (440) plane of a $\gamma$-alumina phase to the diffraction intensity from the (113) plane of an $\alpha$-alumina phase in the measurement of the alumina powder by X-ray diffraction.

5. A method for producing a grain-oriented silicon steel sheet not having inorganic mineral films according to claim 1, further comprising the step of adding magnesia powder having a BET specific surface area of 0.5 to 5 $m^2/g$ to the alumina powder by 5 to 30 weight % relative to the total weight of the alumina powder and the magnesia powder.

6. A method for producing a grain-oriented silicon steel sheet not having inorganic mineral films according to claim 1, wherein the average grain size of the alumina powder is 200 $\mu$m or less.

7. A method for producing a grain-oriented silicon steel sheet not having inorganic mineral films according to claim 5, wherein the average grain size of the magnesia powder is 200 $\mu$m or less.

* * * * *